US011969617B2

(12) United States Patent
Masotta et al.

(10) Patent No.: US 11,969,617 B2
(45) Date of Patent: Apr. 30, 2024

(54) EXERCISE AND THERAPY DEVICE

(71) Applicants: Vincent Michael Masotta, Ridgefield, CT (US); John Robert Masotta, Ridgefield, CT (US)

(72) Inventors: Vincent Michael Masotta, Ridgefield, CT (US); John Robert Masotta, Ridgefield, CT (US)

( * ) Notice: Subject to any disclaimer, the term of this patent is extended or adjusted under 35 U.S.C. 154(b) by 173 days.

(21) Appl. No.: 17/722,923

(22) Filed: Apr. 18, 2022

(65) Prior Publication Data

US 2022/0296952 A1 Sep. 22, 2022

Related U.S. Application Data

(60) Provisional application No. 63/177,054, filed on Apr. 20, 2021.

(51) Int. Cl.

*A63B 21/012* (2006.01)
*A63B 21/00* (2006.01)
*A63B 21/02* (2006.01)

(52) U.S. Cl.

CPC ..... *A63B 21/012* (2013.01); *A63B 21/0004* (2013.01); *A63B 21/028* (2013.01); *A63B 21/4035* (2015.10)

(58) Field of Classification Search

CPC . A63B 21/012; A63B 21/0004; A63B 21/028; A63B 21/4035; A63B 21/0555; A63B 21/0557; A63B 21/0085; A63B 21/0428; A63B 21/0552; A63B 21/4045; A63B 15/00; A63B 21/00043; A63B 21/05; A63B 23/12; A63B 2023/006; A63B 21/0087; A63B 21/00072; A63B 21/023; A63B 21/026; A63B 21/055; A63B 1/00; A63B 15/005; A63B 15/02; A63B 21/00185; A63B 21/008; A63B 21/0083; A63B 21/0088; A63B 21/0089; A63B 21/02; A63B 21/025; A63B 21/04; A63B 21/0407; A63B 21/0442; A63B 21/28

See application file for complete search history.

(56) References Cited

U.S. PATENT DOCUMENTS

| | | | | |
|---|---|---|---|---|
| 1,023,756 A * | 4/1912 | Pons | ..... | A63B 21/05 482/126 |
| 1,714,391 A | 3/1927 | McWhirter | | |
| 2,714,008 A * | 7/1955 | Urban | ..... | A63B 23/14 482/126 |
| 3,343,837 A | 9/1967 | Grzybowski | | |

(Continued)

*Primary Examiner* — Joshua Lee
*Assistant Examiner* — Catrina A Letterman
(74) *Attorney, Agent, or Firm* — Steven A. Nielsen; www.NielsenPatents.com

(57) ABSTRACT

An exercise device 90 may comprise a pair of handle tube assemblies 100 in slideable attachment to a center tube assembly 200 such that the handle tube assemblies move in opposition with resistance sometime proved by an elastic member housed within the center tube and with resistance and/or damping provided the controlled flow of air within the apparatus. A handle tube assembly may comprise a handle tube 104 containing a resistance plug 101 in frictional attachment to a outer cap 103, plug seal 107 and other components. A center tube assembly may comprise, at either end, a return bumper 201, low friction linear bushing 202, center cap 203, extend bumper 205 and other components.

8 Claims, 22 Drawing Sheets

(56) References Cited

U.S. PATENT DOCUMENTS 3,761,083 A 9/1973 Buchner
4,193,593 A * 3/1980 Wilson ..... A63B 23/12 482/122
4,440,391 A 4/1984 Saenz, Jr. et al.
4,775,149 A * 10/1988 Wilson ..... A63B 21/022 482/126
5,029,847 A 7/1991 Ross
5,154,685 A * 10/1992 Chen ..... A63B 21/00043 482/121
D365,861 S 1/1996 Moss, Jr. et al.
6,293,573 B1 * 9/2001 Olde-Heuvel ..... F16F 7/082 280/124.179
6,976,942 B2 12/2005 Kennedy
7,557,286 B2 7/2009 Capostosto
7,652,953 B1 * 1/2010 Fluegge ..... A63B 21/00043 482/131
8,182,420 B2 5/2012 Homan et al.
D733,226 S 6/2015 Abbate
10,569,131 B2 * 2/2020 Niederman ..... A63B 21/015
10,974,087 B1 * 4/2021 Moon ..... A63B 23/1254
2002/0103059 A1 * 8/2002 Kushner ..... A63B 21/0004 482/122
2004/0152571 A1 * 8/2004 Udwin ..... A63B 21/023 482/126
2004/0235624 A1 11/2004 Bruce
2004/0259698 A1 12/2004 Reilly
2008/0081747 A1 * 4/2008 Mok ..... A63B 21/0552 482/121
2008/0182734 A1 * 7/2008 Wu ..... A63B 23/12 482/126
2015/0343255 A1 * 12/2015 Miller ..... A63B 21/0724 482/104
2016/0177991 A1 * 6/2016 Daniels ..... A47H 1/022 403/109.1
2016/0250512 A1 * 9/2016 Siemer ..... A63B 21/02 482/139
2020/0391071 A1 * 12/2020 Pettersson ..... A63B 21/0609
2023/0173320 A1 * 6/2023 Yee ..... A63B 21/023 482/126
2023/0191181 A1 * 6/2023 Westfall ..... A63B 21/0552 482/121
2023/0191183 A1 * 6/2023 Kofron ..... A63B 21/0004 482/110

* cited by examiner

EXERCISE AND THERAPY DEVICE

CROSS-REFERENCE TO RELATED APPLICATIONS

This is a utility application based upon U.S. patent application 63/177,054 filed on Apr. 20, 2021. This related application is incorporated herein by reference and made a part of this application. If any conflict arises between the disclosure of the invention in this utility application and that in the related provisional application, the disclosure in this utility application shall govern. Moreover, the inventor(s) incorporate herein by reference any and all patents, patent applications, and other documents hard copy or electronic, cited or referred to in this application.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION

(1) Field of the Invention

The invention generally relates to exercise devices. More particularly, the invention relates to means and methods of creating a rigid, linear, self-contained, therapeutic exercise device where the user pulls handles outwardly to gently activate and strengthen their back and other muscles, thereby helping to promote improved posture, flexibility, circulation and counteract daily work/life contributors to anatomical and physiological atrophy and stress.

(2) Description of the Related Art

The known related art fails to anticipate or disclose the principles of the present invention.

In the related art, general stick type exercise devices are known, but fail to provide the benefits or design advantages of the disclosed embodiments.

For example, U.S. Published Patent Application 2004/0259698 published on Dec. 23, 2004 does provide telescopic movement along a linear longitudinal path, but fails to provide damping as found in the disclosed embodiments.

U.S. Pat. No. 4,440,391 issued to Saenz, Jr. et al on Apr. 3, 1984 discloses an exercise device designed to flex during use. The disclosed embodiments eschew longitudinal flex and provide reliable means of extension and contraction with no or minimal flex. Thus, there is a need in the art for the presently disclosed embodiments.

U.S. Pat. Nos. 818,242, 3,761,083, and 4,775,149 are in the general field of the disclosed embodiments. The three patents: disclose springs external to the central tube, whereas the present embodiments have internal resilient members; disclose handles in discreet positions, whereas the present embodiments allow for gripping anywhere upon the external tubes, are of fixed length with handles moving along the fixed length, whereas the present embodiments, have a dynamic length and may be stored in a compact state.

U.S. Pat. No. 3,343,837 issued to Grzybowski on Sep. 16, 1967 discloses two tubes in telescopic arrangement with springs inside the tubes, with the springs fastened to the distal ends of the tubes to keep the device contracted. Grzybowski discloses an inner and outer tube with a spring between the tube ends. The presently disclosed embodiments use three tubes and a center stopper.

BRIEF SUMMARY OF THE INVENTION

The present invention overcomes shortfalls in the related art by presenting an unobvious and unique combination and configuration of methods and components to construct a self-contained device that may comprise a lightweight, but rigid center tube with two similar surrounding, slightly larger-in-diameter shorter tubes forming handles on both ends. The handles travel along the center tube in opposite directions as the user pulls the handles outwardly with resistance supplied by an elastic member housed within the center tube, and additionally by metering of air within the device, causing the engagement of the user's back and other muscles.

These and other objects and advantages will be made apparent when considering the following detailed specification when taken in conjunction with the drawings.

REFERENCE NUMERALS IN THE DRAWINGS

Figure 1:
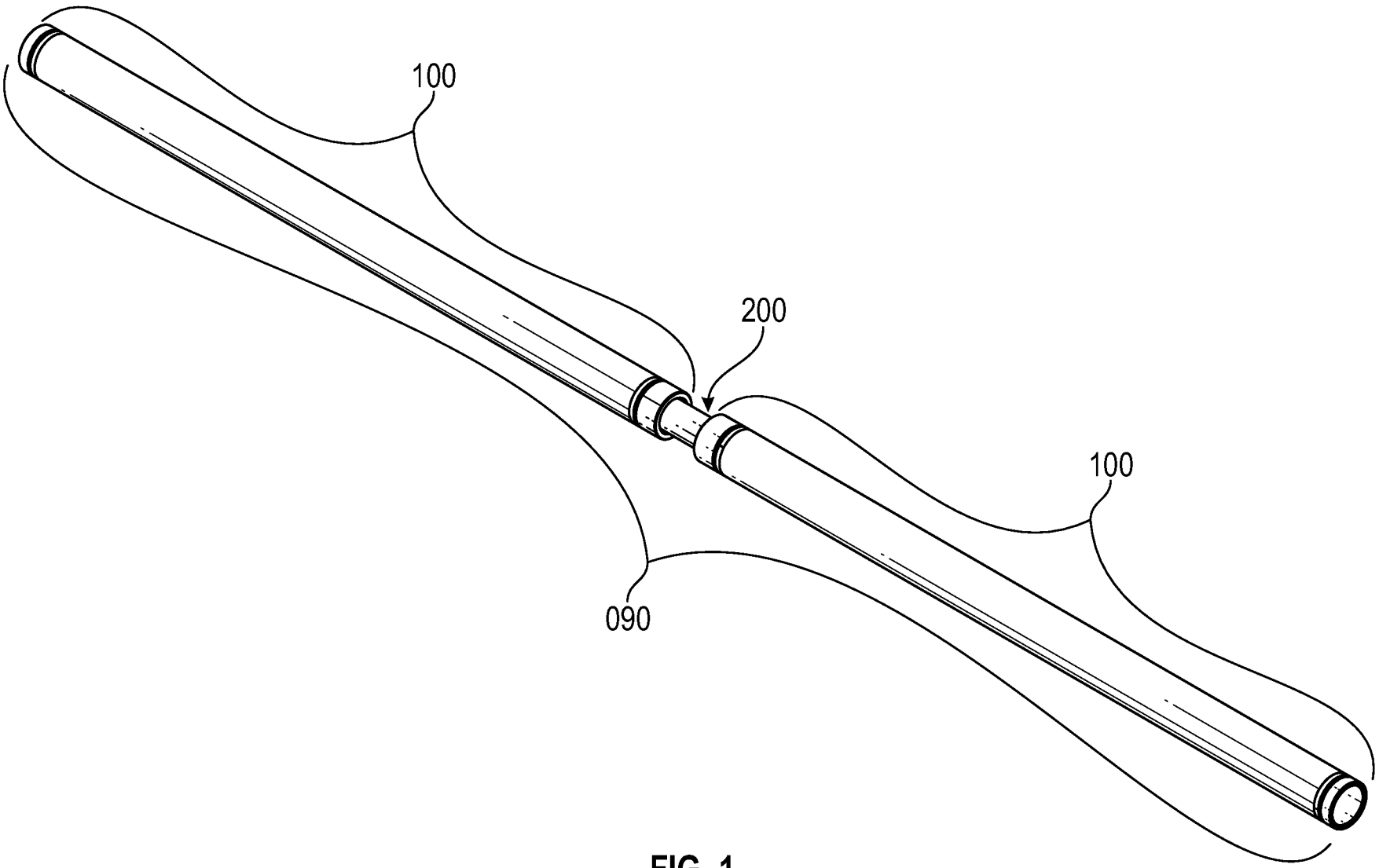
FIG. 1 perspective view of a disclosed embodiment

90 disclosed embodiment
100 handle tube assembly
101 resistance member plug
102 resistance member plug retainer
103 outer cap
104 handle tube
105 inner cap
106 low friction linear bushing or linear bushing or bushing
107 resistance member plug seal o-ring
115 barbed protrusion of resistance member plug 101
116 split void defined within a linear bushing 106
117 machined groove or void defined within an inner cap 105, sometimes used to retain a linear bushing 106
118 connecting edge of resistance member plug retainer 102
200 center tube assembly
201 return bumper
202 low friction linear bushing or linear bushing or bushing
203 center cap
204 center tube
205 extend bumper
220 split or void defined within bushing 202
221 machined groove or void defined within a center cap 203, sometimes used to retain a linear bushing 202
300 elastic resistance assembly
301 elastic resistance member
302 center stopper
330 center mark; defined within elastic resistance member 301
331 "as installed" mark defined within elastic resistance member 301
332 "stretched" region defined within elastic resistance member 301
333 slot void defined within center stopper 302
334 centering void defined within center stopper 302
335 tooth protrusions defined within center stopper 302
336 connecting edge of center stopper 302
400 initial volume of air contained within the center tube assembly 200 when in the retracted position
401 initial volumes of air contained within the handle tube assemblies 300 when in a retracted position
402 additional volumes of air contained within the handle tube assemblies 300 when in an extended position
500 directional arrow showing a primary degree of freedom
510 deflection or bending moment applied by user
520 bowed or deflected shape that would occur if the device was not rigid
530 reaction forces between handle tubes 104 and bushing 202 and between center tube 204 and bushings 106
540 straight dashed line showing no deflection due to rigidity of device
550 arrows showing secondary rotational degree of freedom

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

FIG. 1 depicts a disclosed embodiment 90 that may comprise a center tube assembly 200 in slidable connection to a pair of handle tube assemblies 100. The embodiment is shown in a retracted or closed position, ready for use.

Figures 2A, 2B:
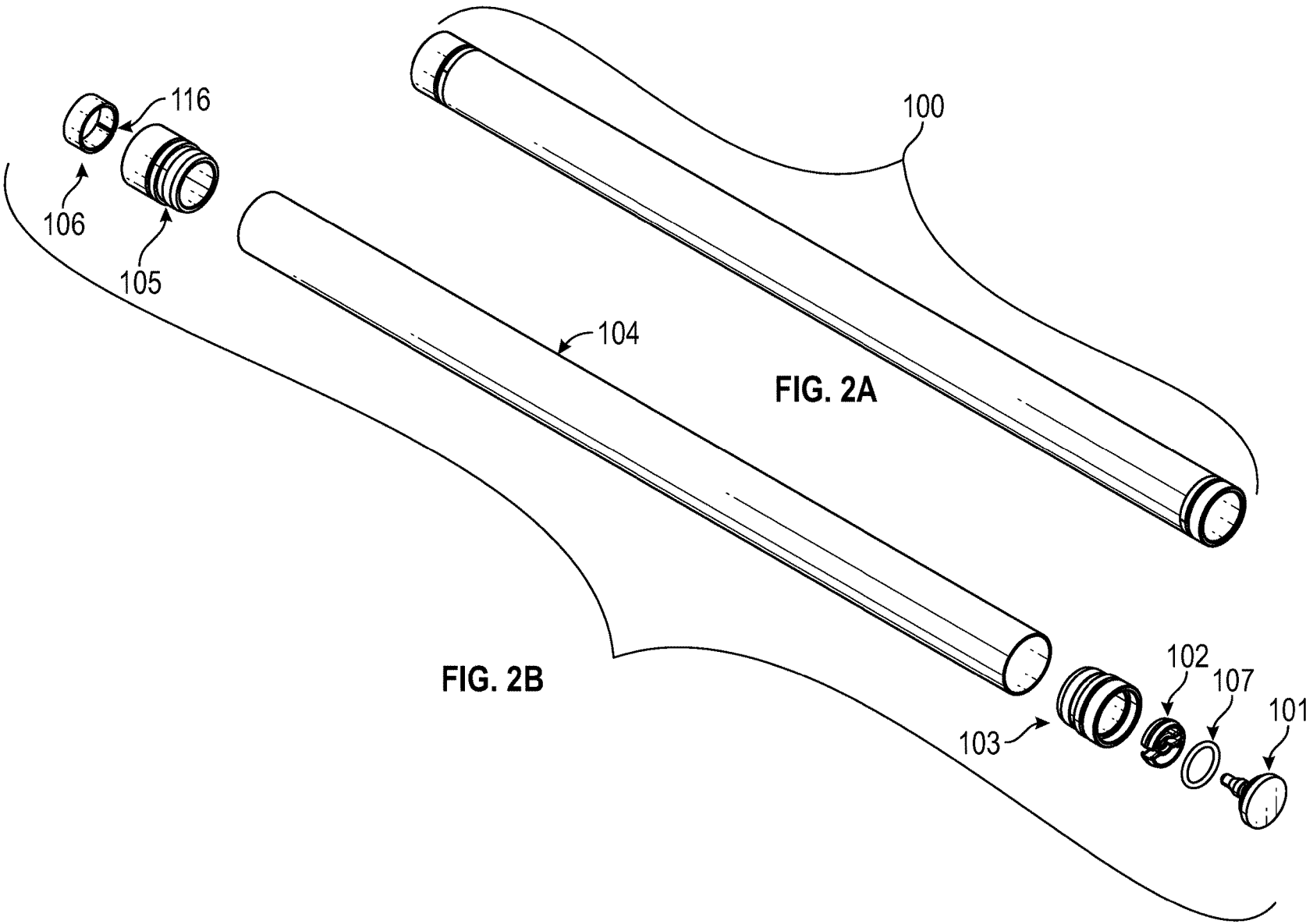
FIG. 2A perspective view of an assembled handle tube assembly
FIG. 2B exploded view of a handle tube assembly

FIG. 2A depicts a handle tube assembly 100.

FIG. 2B depicts an exploded view of a handle tube assembly 100 exposing a resistance member plug 101, a resistance member plug retainer 102, a resistance member plug seal o-ring 107, an outer cap 103, a handle tube 104, an inner cap 105, a low friction linear bushing 106 and a split void 116 defined within a low friction linear bushing 106.

Figures 3A, 3B:
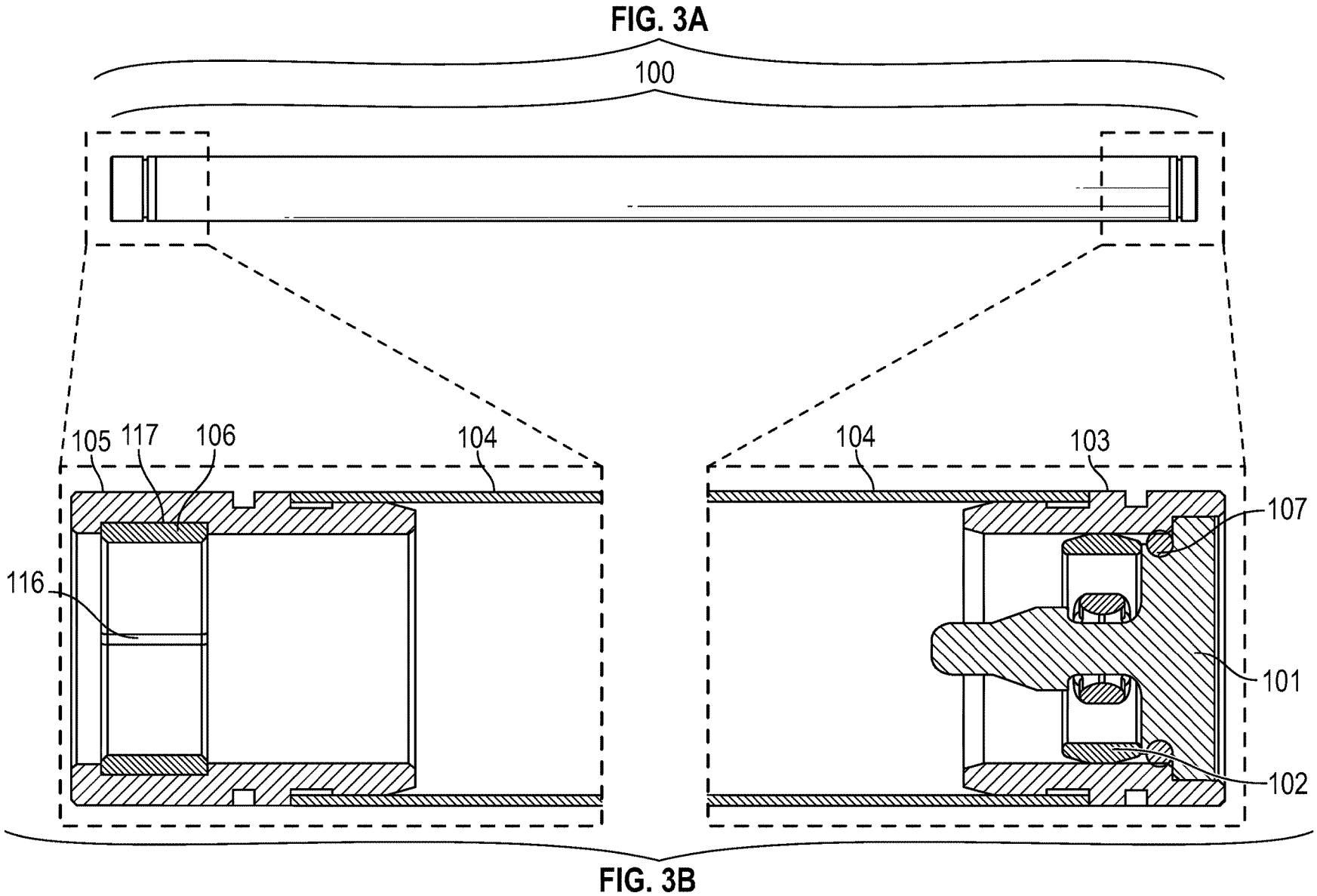
FIG. 3A plan view of a handle tube assembly
FIG. 3B two sectional views of a handle tube assembly

FIG. 3A a plan view of a handle tube assembly 100, with components at either end shown in a sectional view in FIG. 3B.

FIG. 3B depicts components that may include a resistance member plug 101, a resistance member plug retainer 102, a resistance member plug seal o-ring 107, an outer cap 103, a handle tube 104, an inner cap 105, a low friction linear bushing 106 and a split void 116 defined within a low friction linear bushing 106. The inner cap 105 may define a void 117, which may be a machined groove, the inner cap void 117 may be used to secure a low friction linear bushing 106.

In general, a linear bushing 106 may be retained within an inner cap void 117. A resistance member plug 101 may be retained by a resistance member plug retainer 102 such that the resistance member plug retainer 102 is in frictional attachment to an outer cap 103.

Figure 3C:
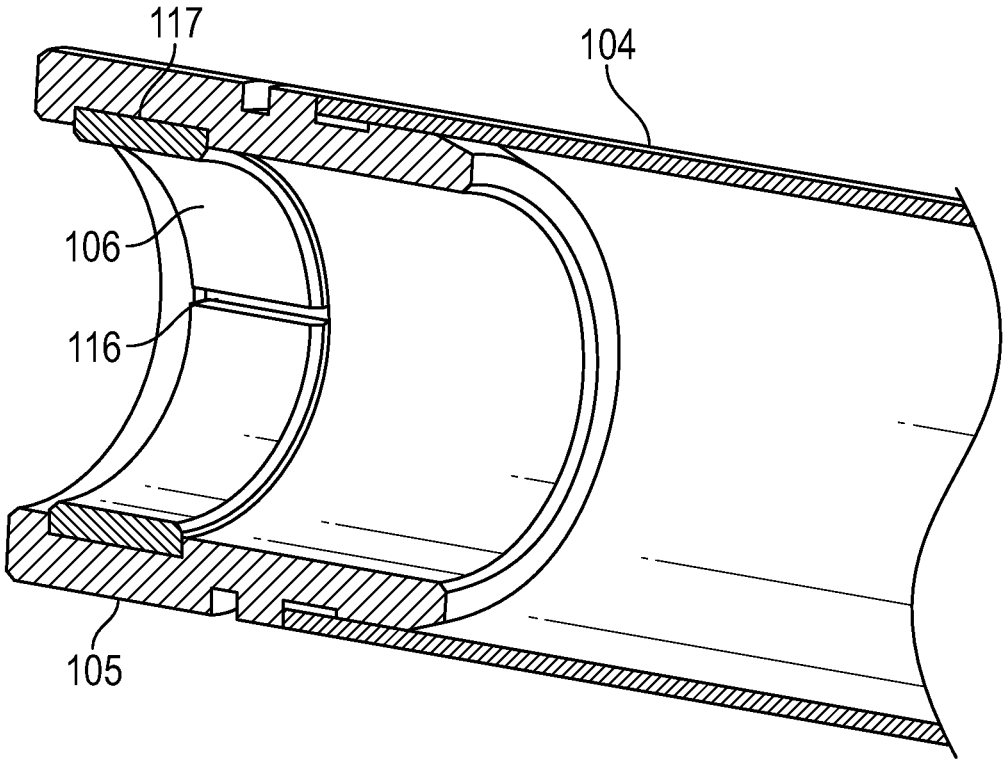
FIG. 3C perspective view of sectional view of handle tube assembly components FIG. 4A perspective view of a center tube assembly FIG. 4B exploded view of a center tube assembly components FIG. 5A plan view of center tube assembly FIG. 5B two sectional views of a center tube assembly FIG. 5C perspective sectional view of center tube assembly components FIG. 6A perspective view of an elastic resistance member and center stopper FIG. 6B enlarged view of an elastic resistance member and center stopper FIG. 6C plan view of a center detail of an elastic resistance member and center stopper FIG. 7A perspective view of a resistance member plug and disclosed components FIG. 7B perspective view of a resistance member plug retainer and disclosed components FIG. 7C perspective and assembled view of the disclosed components of FIG. 7B FIG. 7D sectional view of handle tube assembly components FIG. 8A plan view of a disclosed embodiment in a retracted position FIG. 8B two sectional views of disclosed components from FIG. 8A FIG. 9A plan view of a disclosed embodiment in an extended position FIG. 9B sectional view from FIG. 9A

FIG. 3C is a perspective and sectional view of some components of FIG. 3B. A low friction linear bushing 106 is shown retained within an inner cap void 117, the inner cap void defined within an inner cap 105.

Figure 4A:
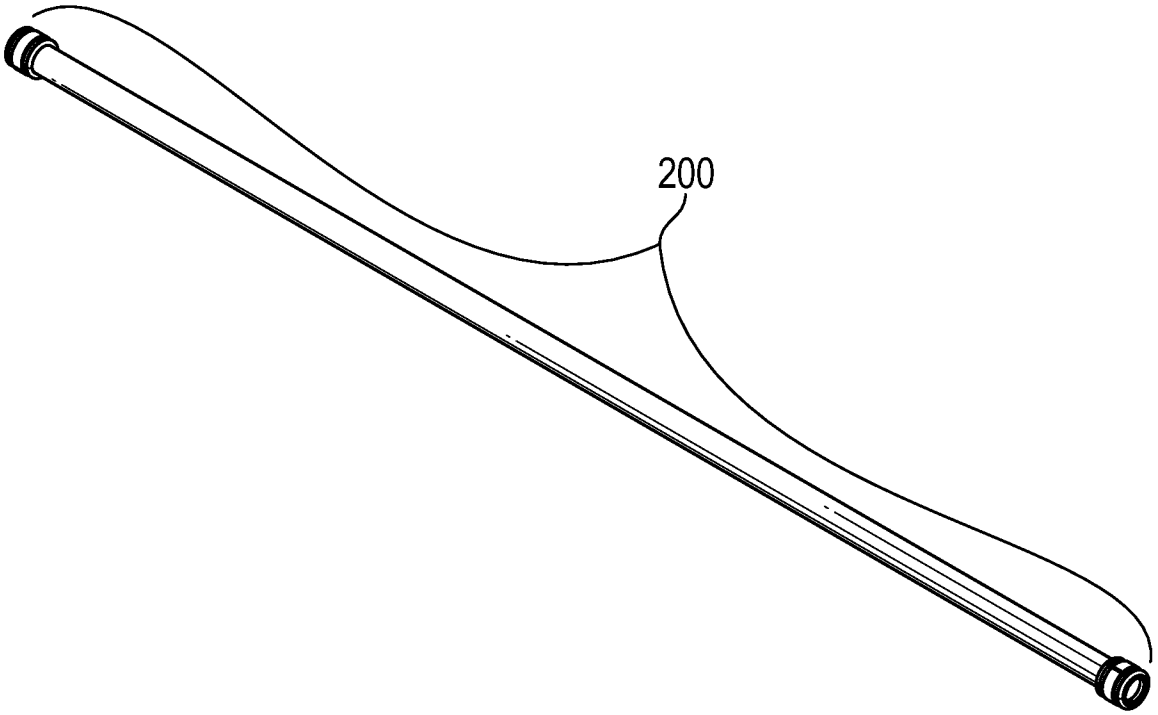
Figure 4B:
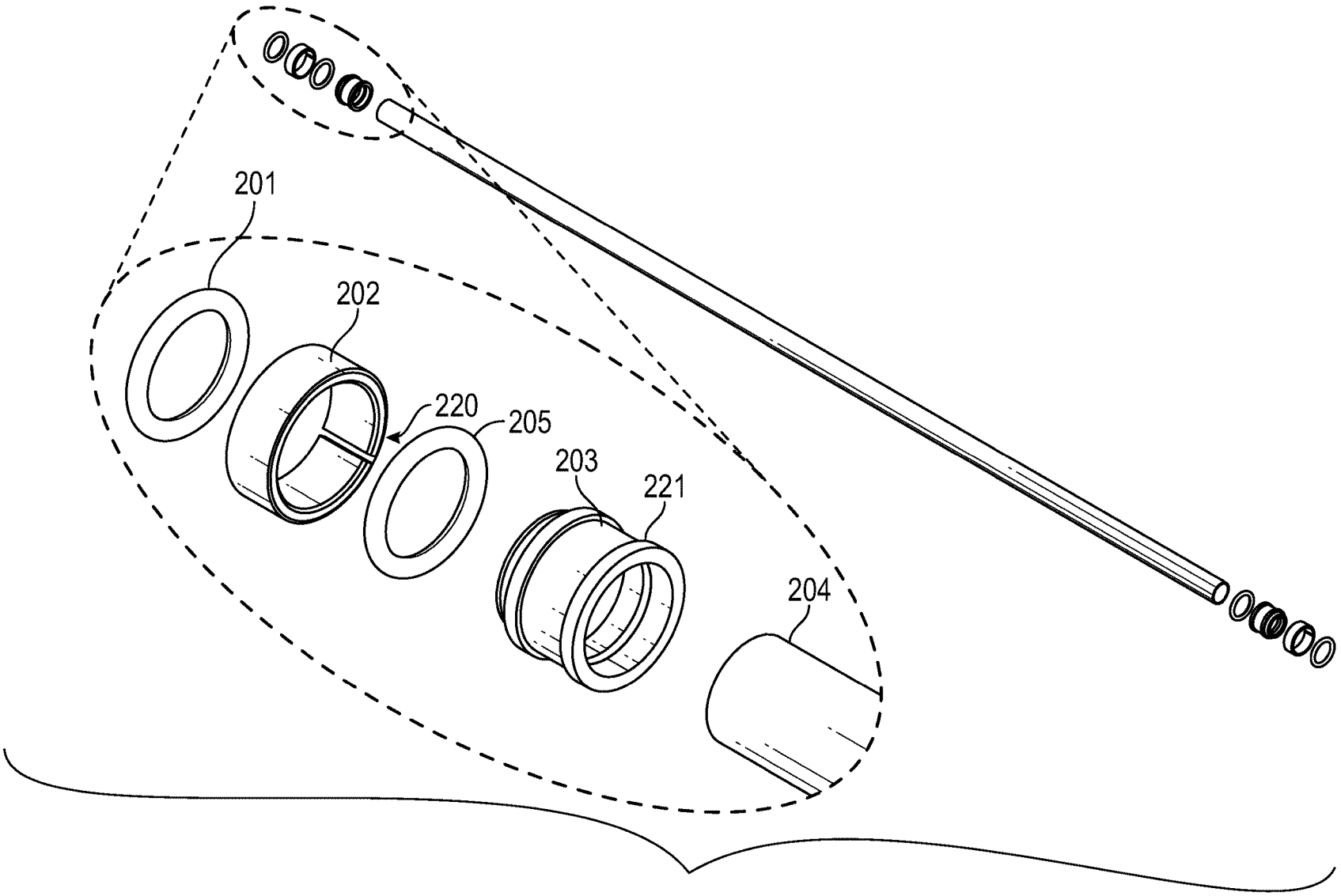

FIG. 4A depicts a perspective view of a center tube assembly 200 with end components shown in adjacent exploded view in FIG. 4B.

FIG. 4B depicts center tube assembly components that may comprise a center ridge tube 204 disposed within a center void defined within a cap 203. The cap 203 may define an exterior void 221 that may accept a linear bushing 202 with the linear bushing defining a split void 220. The return bumper 201 may be disposed within an exterior void defined in cap 203. The extend bumper 205 may be wrapped around center tube 204, and held in place by center cap 203.

Figures 5A, 5B:
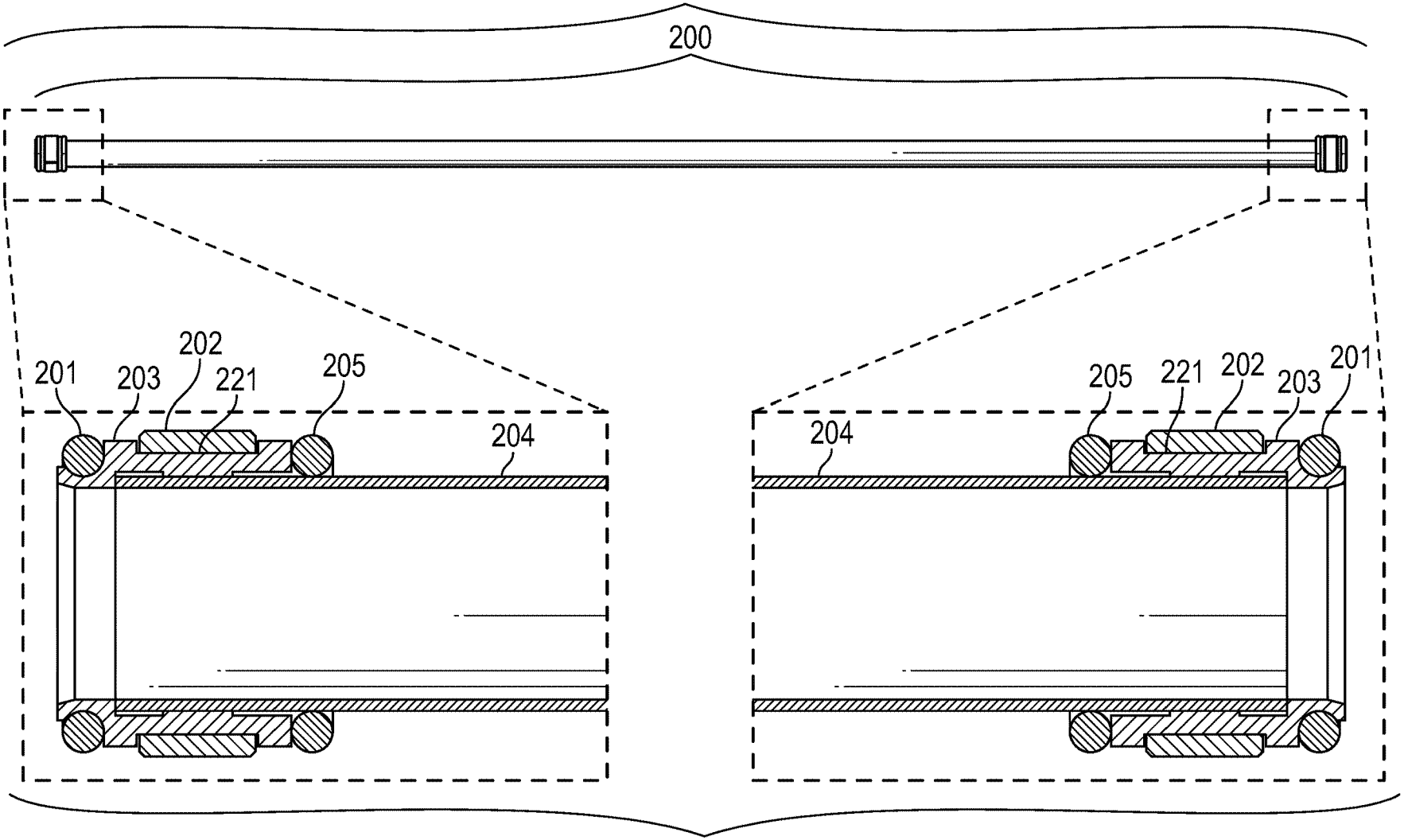

FIG. 5A depicts a plan view of a center tube assembly 200 having two distal ends further shown in sectional view FIG. 5B.

FIG. 5B depicts a sectional view of rigid tube assembly components that may comprise a center tube 204 attached on either end to a center cap 203 with each center cap retaining a low friction linear bushings 202 within a void 221, the void defined within a center cap, and with distal edges of each center cap retaining a return bumper 201. Extend bumpers 205 are shown wrapped around center tube 204 and abutting center caps 203.

Figure 5C:
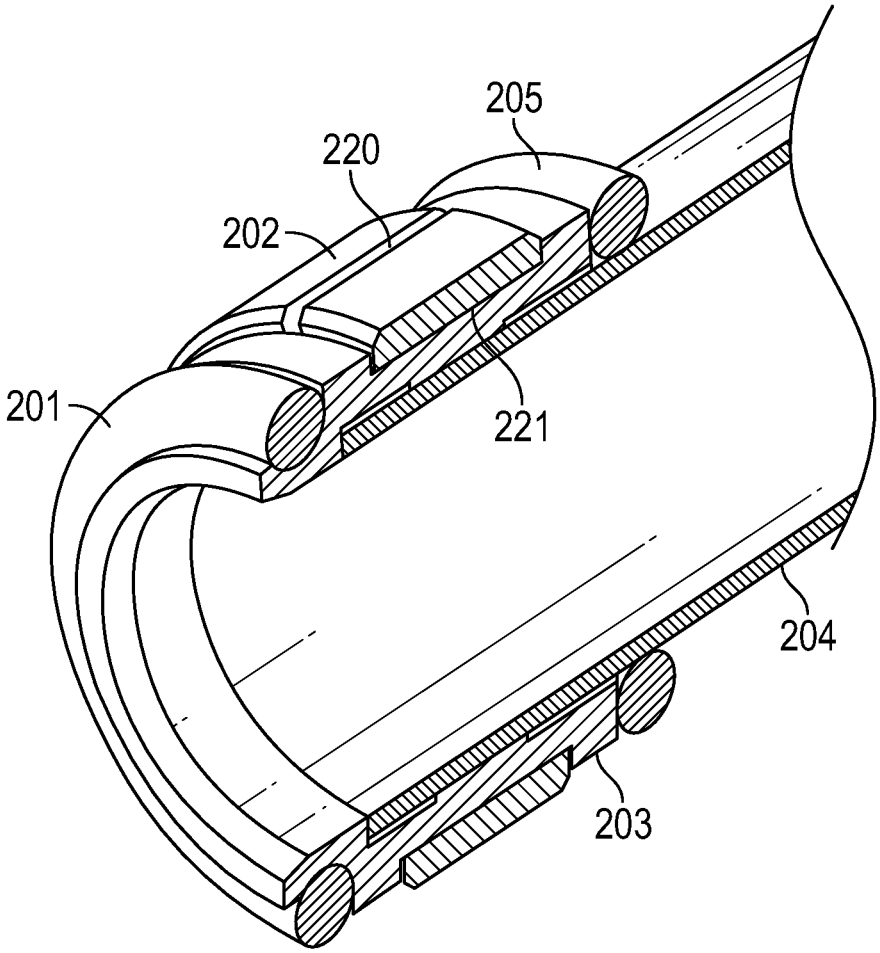

FIG. 5C depicts a perspective and sectional view of a distal end of a disclosed embodiment. In the foreground a return bumper 201 is shown. On the opposite end of cap 203 an extend bumper 205 is shown. FIG. 5C further depicts a center indentation 221 defined within the outer circumference of a center cap, with the center indentation retaining a low friction linear bushing or other type of bushing 202 with the linear bushing defining a split void 220.

Figure 6A:
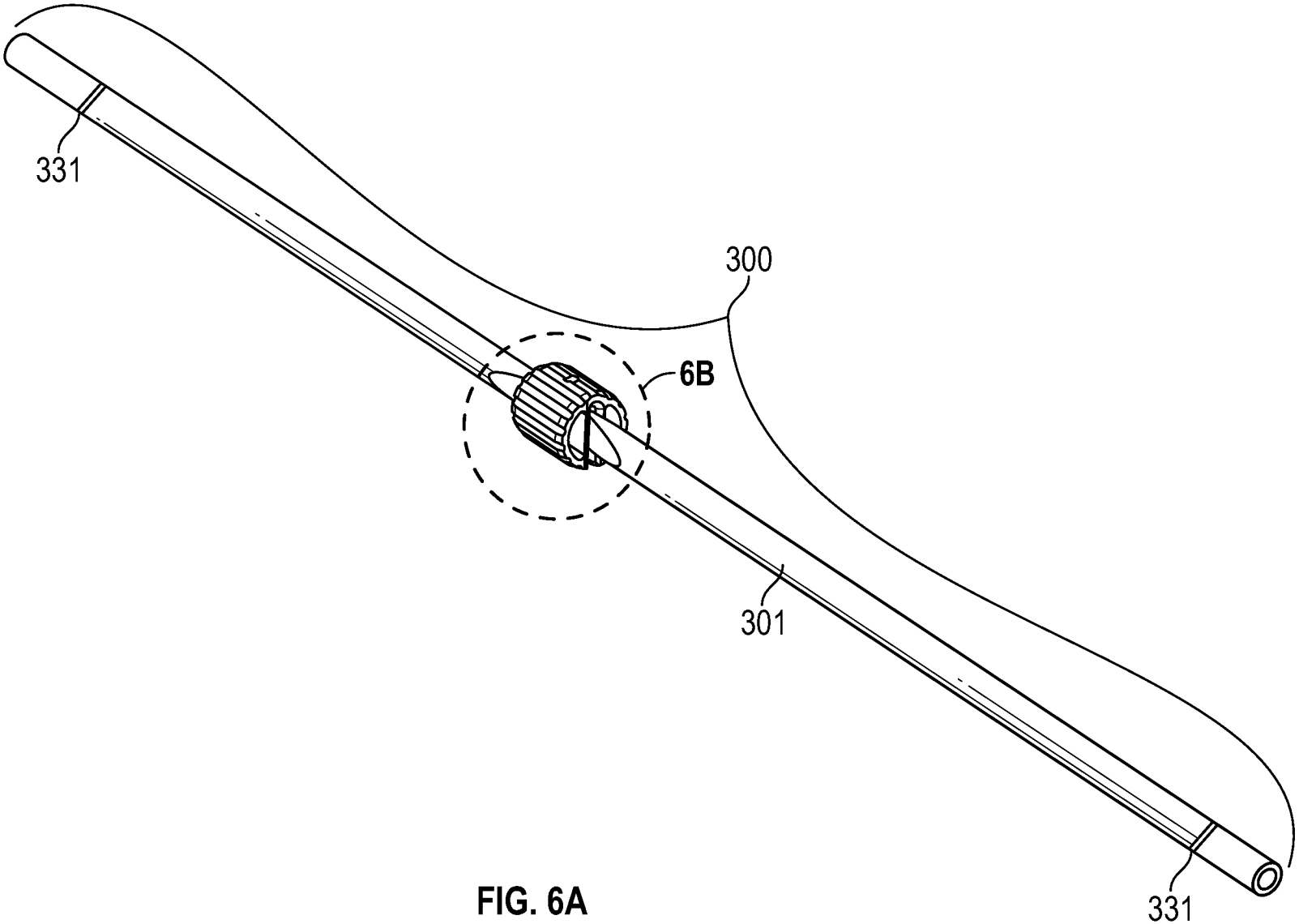

FIG. 6A depicts a perspective view of an elastic resistance assembly 300, shown with a pair of marks 331 the marks defined within the elastic resistance member 301. The marks 331 are sometimes referred to as "as installed marks" as the marks can be used as a guide to cut the elastic resistance member which may take the form of a tube or other elastic member or other means of resistance.

Figure 6B:
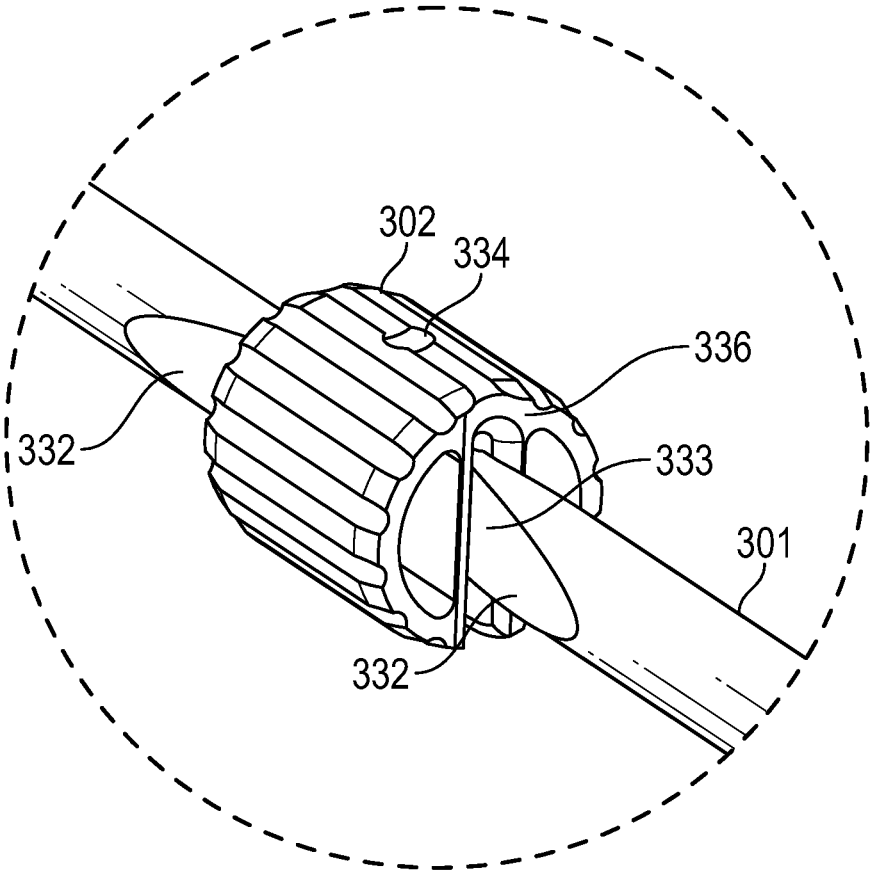

FIG. 6B is a perspective view of center components that may comprise an elastic resistance member 301, with the elastic resistance member defining or forming a stretched region 332, allowing the elastic resistance member to fit within a slot void 333, the slot void defined within the center stopper 302. The center stopper may further define a connecting edge 336. The center stopper may further define a center void 334.

Figure 6C:
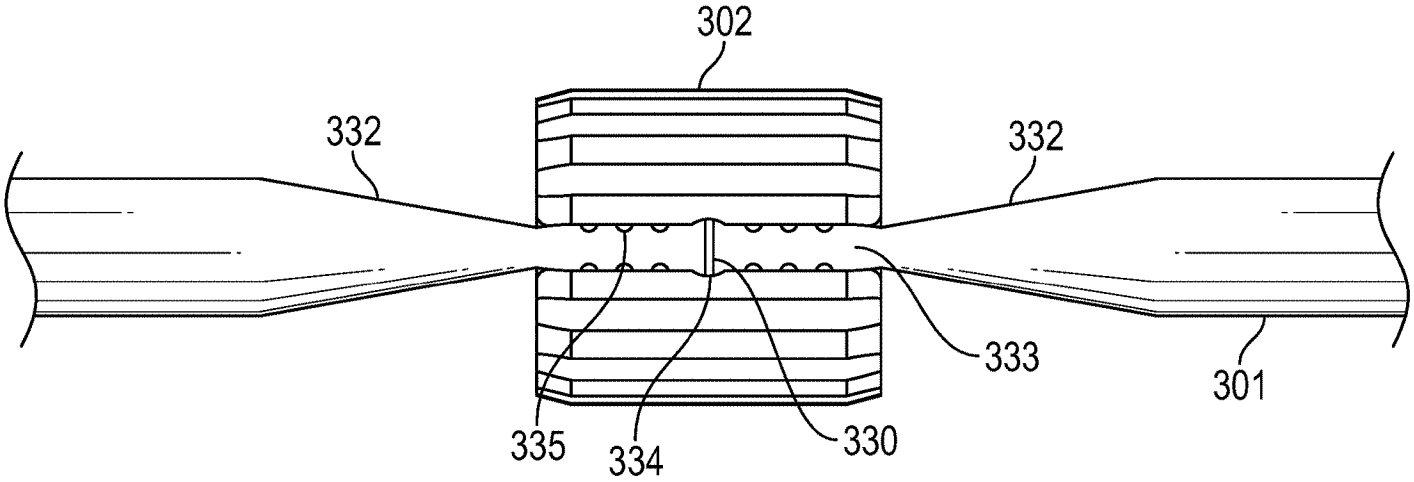
Figure 7A:
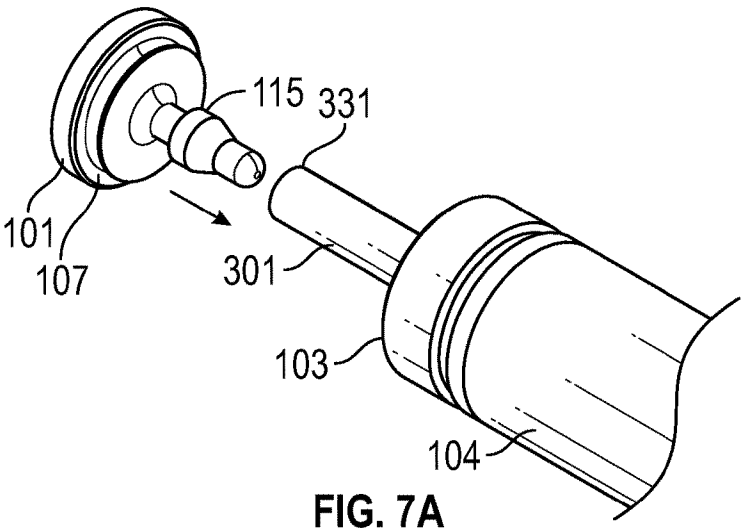
Figure 7B:
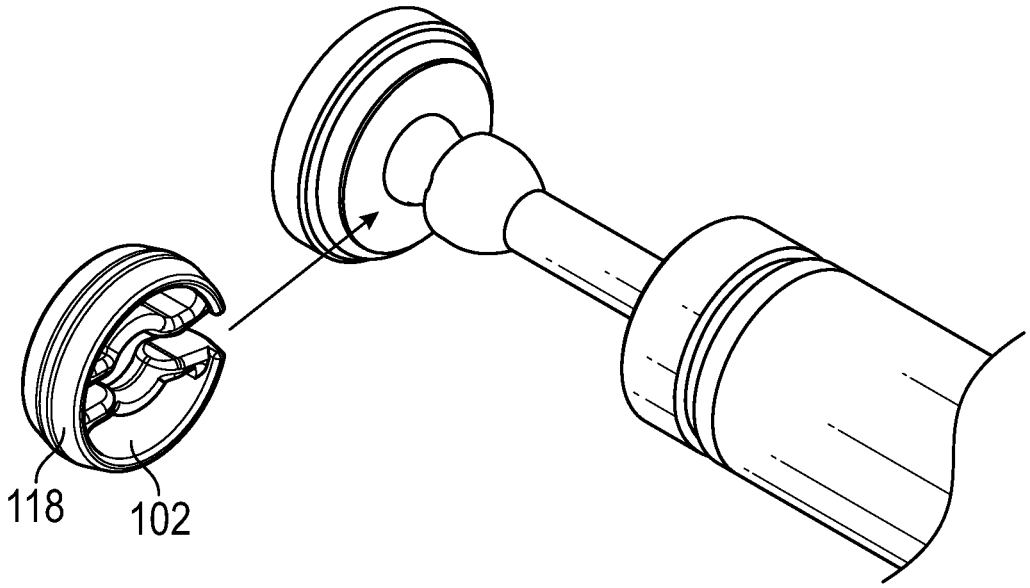
Figure 7C:
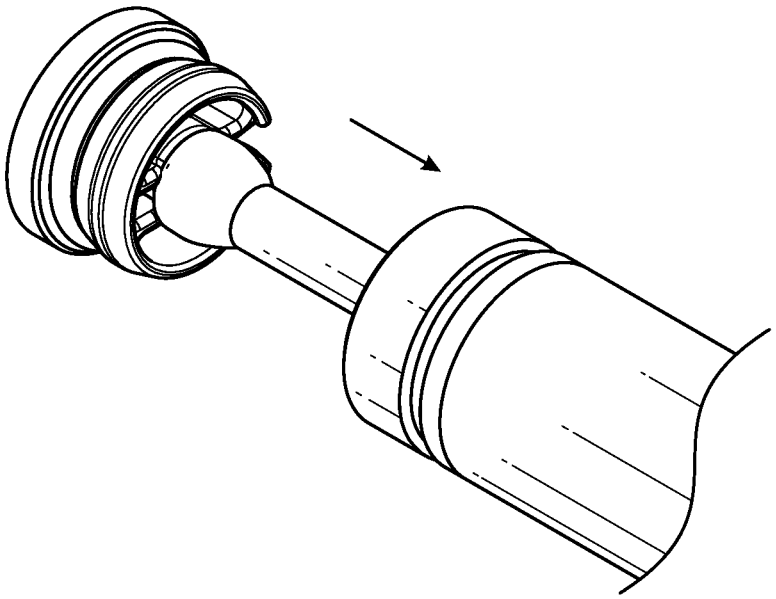
Figure 7D:
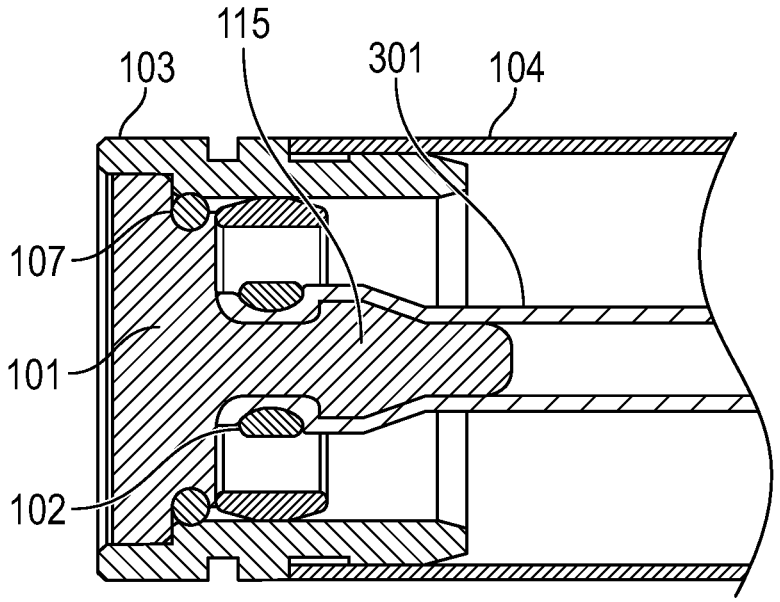

FIG. 6C is a plan view of center components that may comprise an elastic resistance member 301, the elastic resistance member having a stretched section 332 or thin section, with the thin or stretched section fitting into or retained with tooth protrusions 335, the tooth protrusions defined within or by the center stopper 302. The center stopper may define a centering void 334 that may be used to view or align a center mark 330, with the center mark sometimes placed at or near the center of an elastic resistance member.

FIGS. 7A to 7D depict means of connection between components of the handle tube assembly and components of the elastic resistance assembly.

An elastic resistance member 301 may accept or be fastened or retained by a barbed protrusion 115 the barbed protrusion disposed upon a resistance member plug 101. The barbed protrusion 115 may be inserted into an outer or distal end of an elastic resistance member 301 or other means of resistance with the distal end of the elastic resistance member defined by or cut upon an "as installed" mark 331 disposed upon the elastic resistance member.

A resistance member plug retainer 102 may be inserted into a resistance member plug 101. The resistance member plug retainer may comprise a connecting edge 118. A resistance member plug seal o-ring 107 is shown between resistance member plug 101 and outer cap 103.

Figures 8A, 8B:
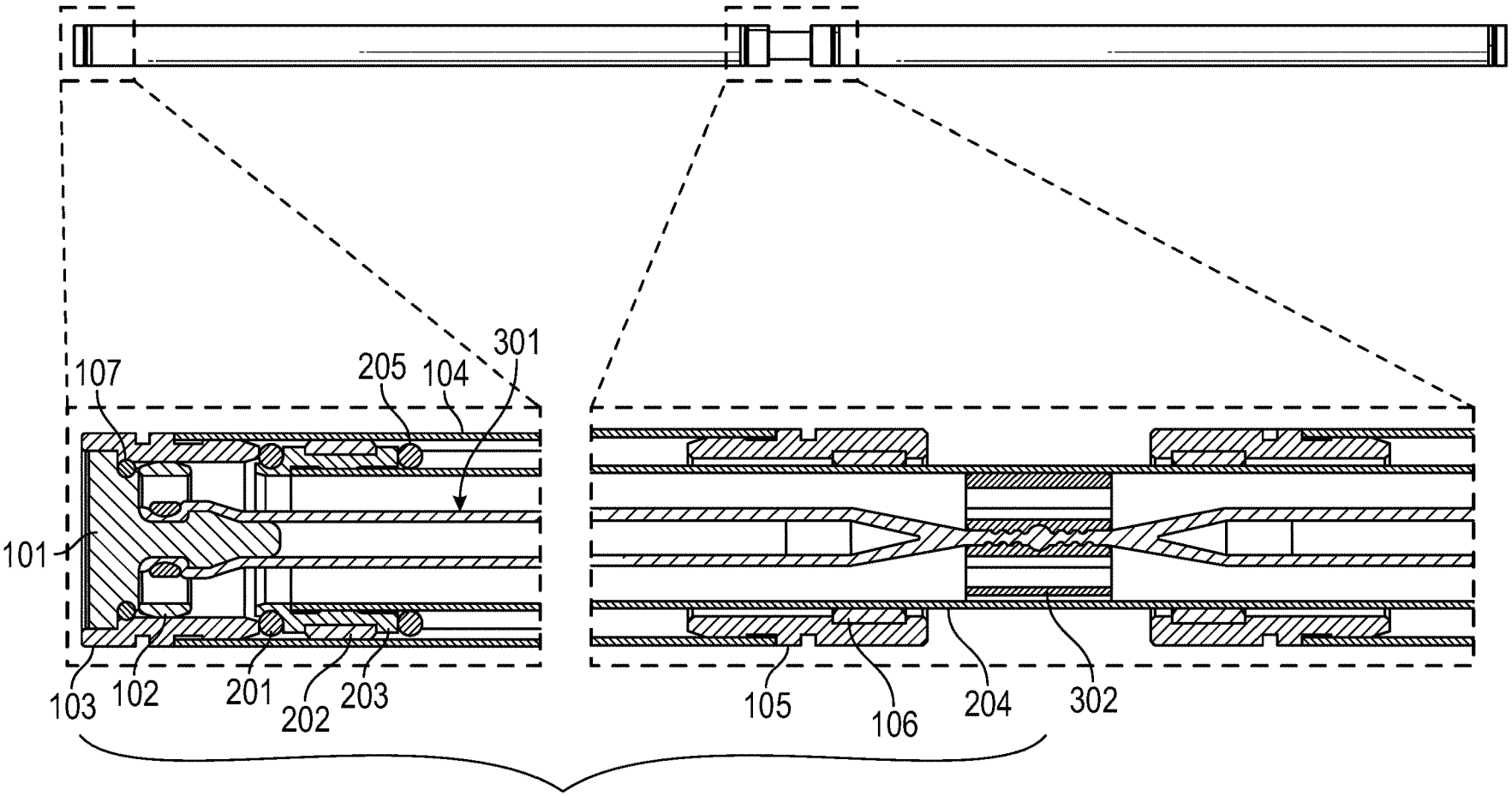

FIG. 8A is a plan view of a disclosed embodiment in a fully retracted position used as a reference for the sectional view of FIG. 8B.

FIG. 8B depicts connection elements of the handle tube assembly components when the device is in a fully retracted position, center tube assembly components and various elastic resistance assembly components. In general, an elastic resistance member may be secured within a center stopper 302 and at a distal end of a handle while various portions of the center tube are exposed as the handles move in response to being used for exercise.

Figures 9A, 9B:
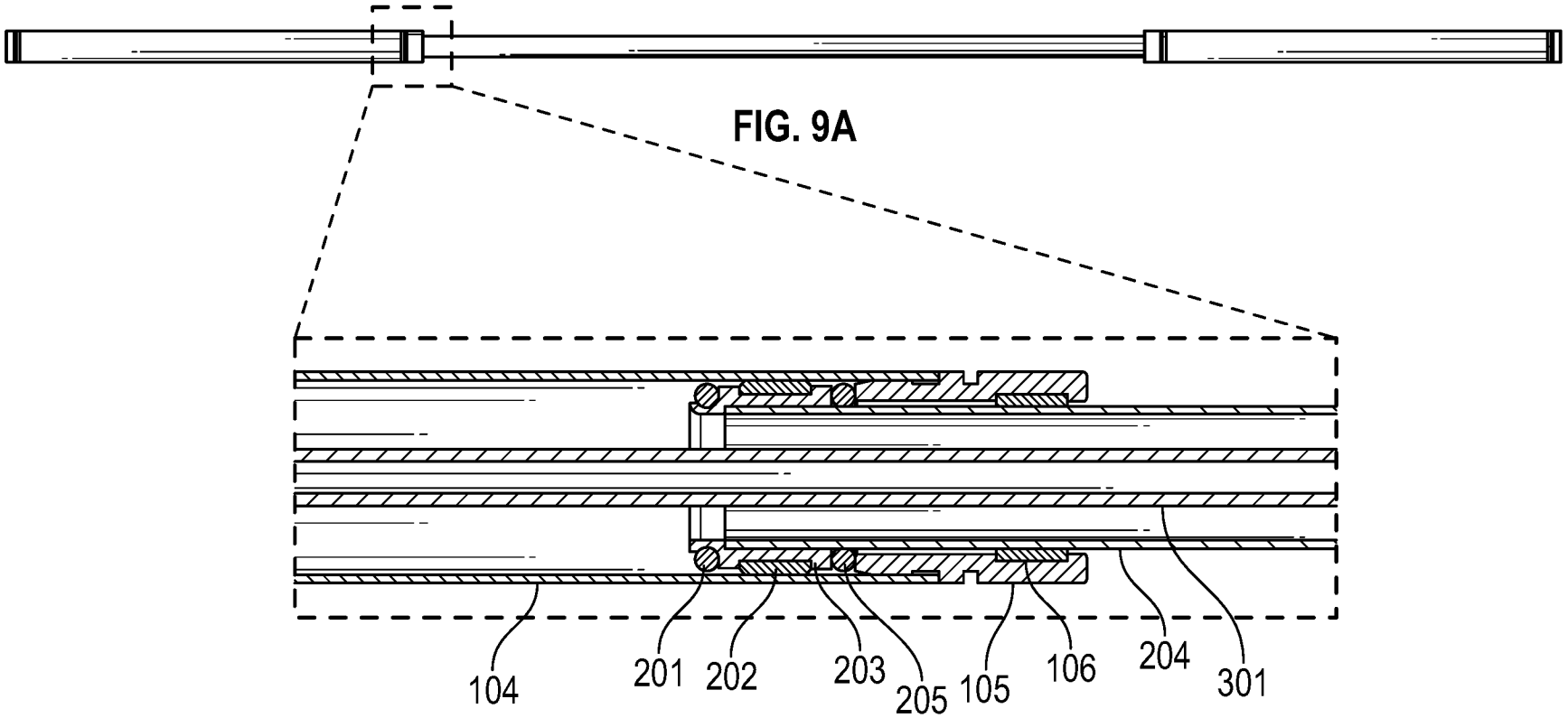

FIG. 9A is used to show the junction between a handle and center tube when the device is in a fully extended position.

FIG. 9B is a sectional view of a junction between a handle and a center tube when the device is in a fully extended position.

Figures 10A, 10B:
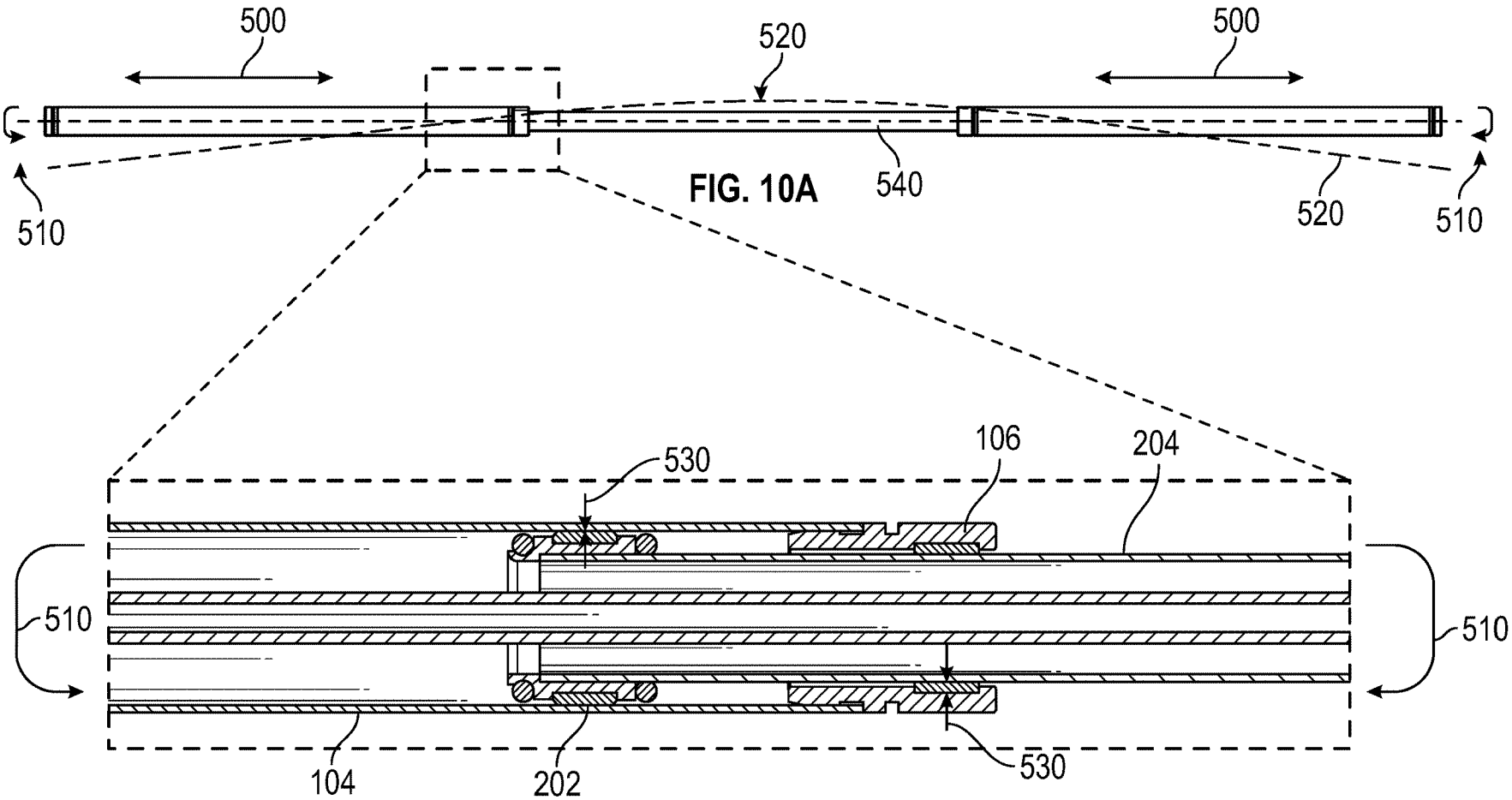
FIG. 10A is a plan view of the device in a nearly fully extended position
FIG. 10B is a sectional detail of FIG. 10A

FIG. 10A is a plan view of a disclosed embodiment in a nearly extended position. The figure depicts the bending moment or force a user could exert 510 on the device during use, and the bowed shape the device would take 520 if it were not sufficiently rigid. The figure also depicts the primary linear degree of freedom 500 between the handle tubes and the center tube. A straight and centered dashed line 540 depicts no deflection due to the rigidity of the device.

FIG. 10B is a sectional detail of FIG. 10A showing the counter forces 530 generated inside a disclosed embodiment between the low friction bushings and the handle tubes and center tube.

Figure 10C:
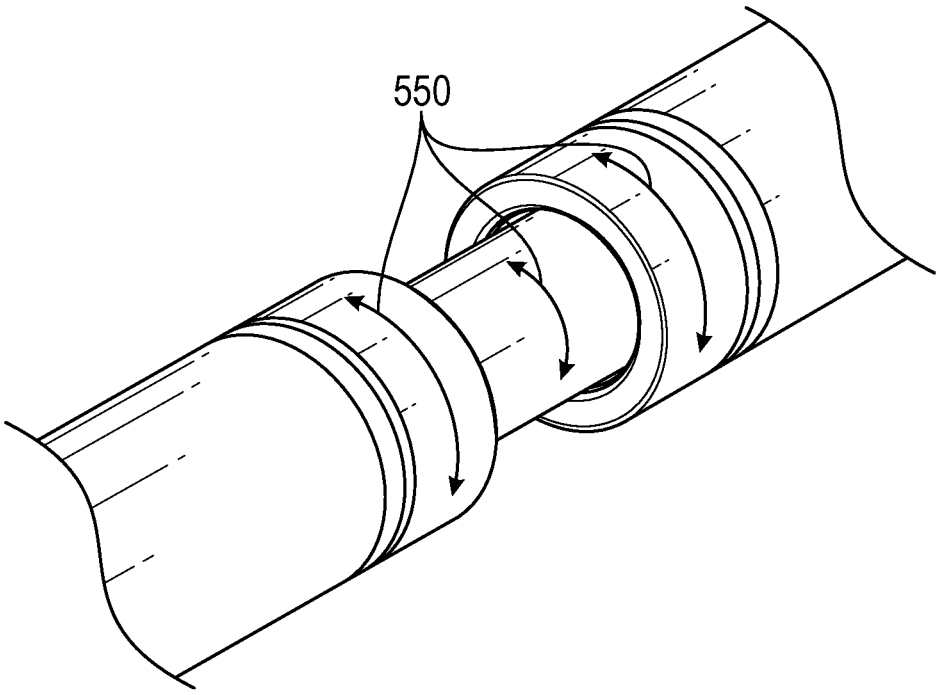
FIG. 10C is a perspective view of a center section of an assembled embodiment FIG. 11A simplified sectional view of an embodiment in a retracted position FIG. 11B simplified sectional view of an embodiment in an extended position

FIG. 10C is a perspective detail view of the center of a disclosed embodiment, depicting the secondary rotational degree of freedom 550 between the handle tubes and the center tube.

Figure 11C:
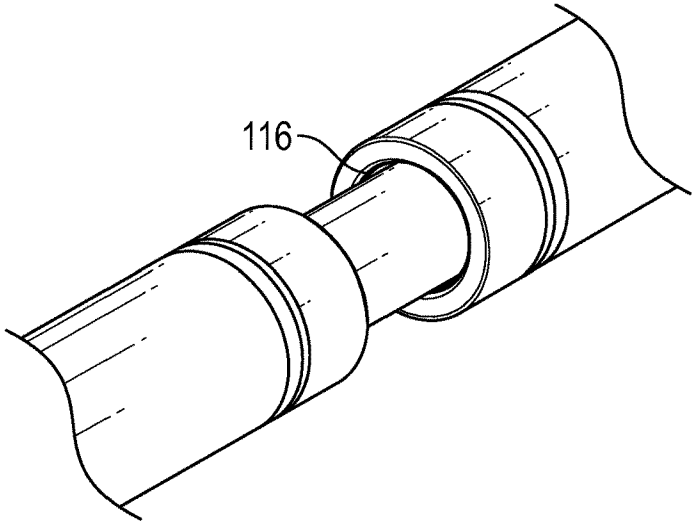
FIG. 11C is a perspective detail of an assembled embodiment
Figure 11A:
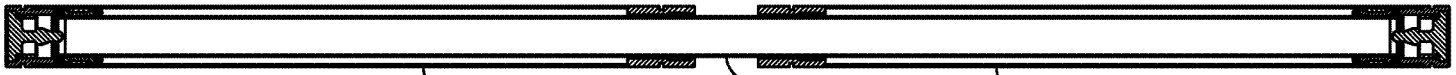

FIG. 11A is a simplified sectional view depicting the internal volume of air 400 and 401 contained within a disclosed embodiment when in the retracted position. Item 300 omitted for clarity.

Figure 11B:
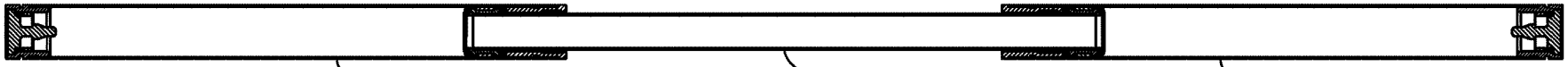

FIG. 11B is a simplified sectional view showing the larger internal volume of air 400 and 402 contained within a disclosed embodiment when in the extended position. Item 300 omitted for clarity.

FIG. 11C depicts detail of the location of split 116 within bushing 106.

Figure 12A:
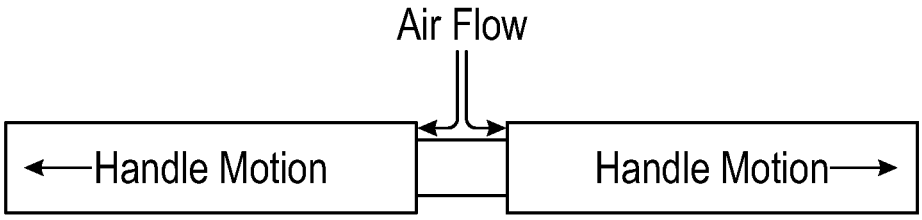
FIG. 12A is a simplified plan representation of an assembled embodiment in a retracted position showing airflow and handle motion

FIG. 12A is a simplified representation of a disclosed embodiment depicting the air damping effect on the extend stroke.

Figure 12B:
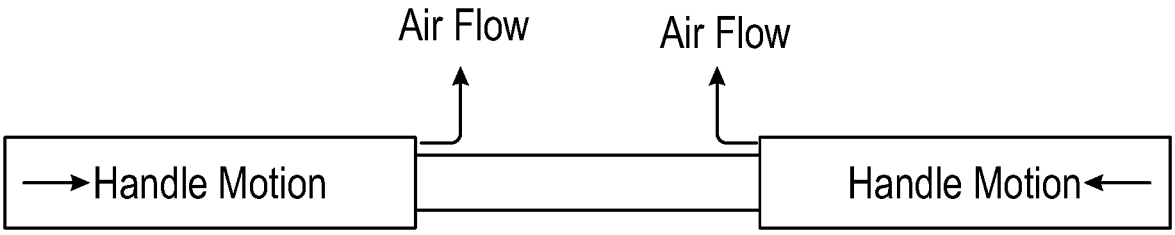
FIG. 12B is a simplified plan representation of an assembled embodiment in an extended position showing airflow and handle motion

FIG. 12B is a simplified representation of a disclosed embodiment showing the air damping effect on the retract stroke.

Figure 13A:
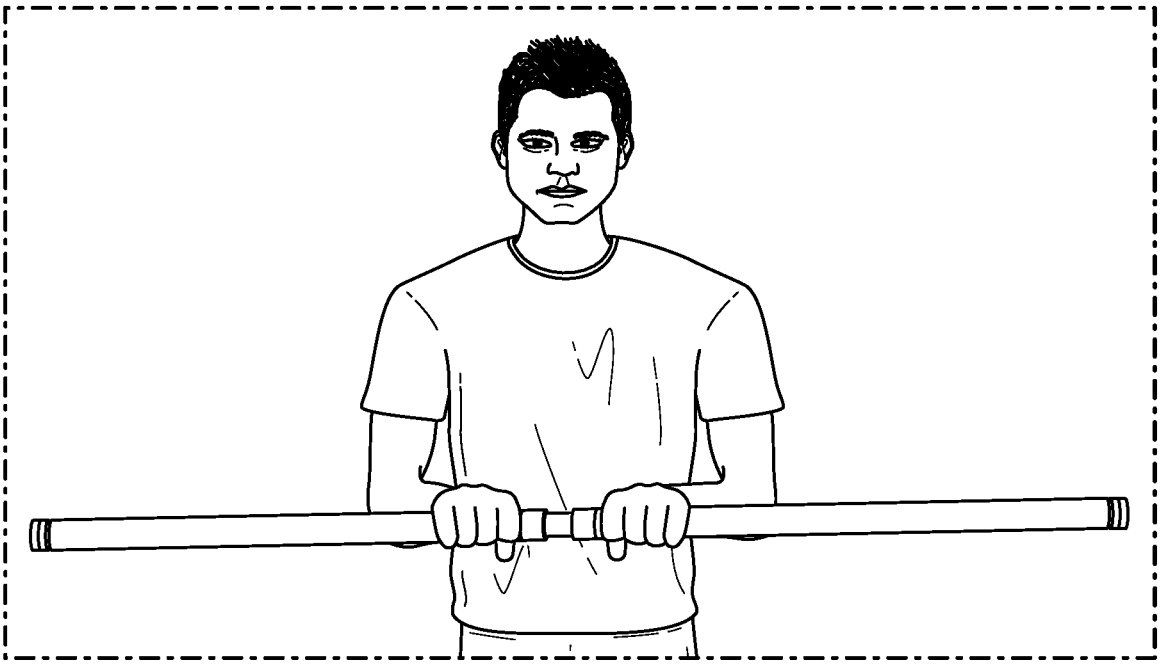
FIGS. 13A, 13B, 14A, 14B, 15A, 15B depict disclosed embodiments in use in various states of extension and exercise positions

FIG. 13A illustrates a disclosed embodiment in use, showing an embodiment in the retracted position with the user having a narrow grip (both hands are at the inside ends of the handles)

Figure 13B:
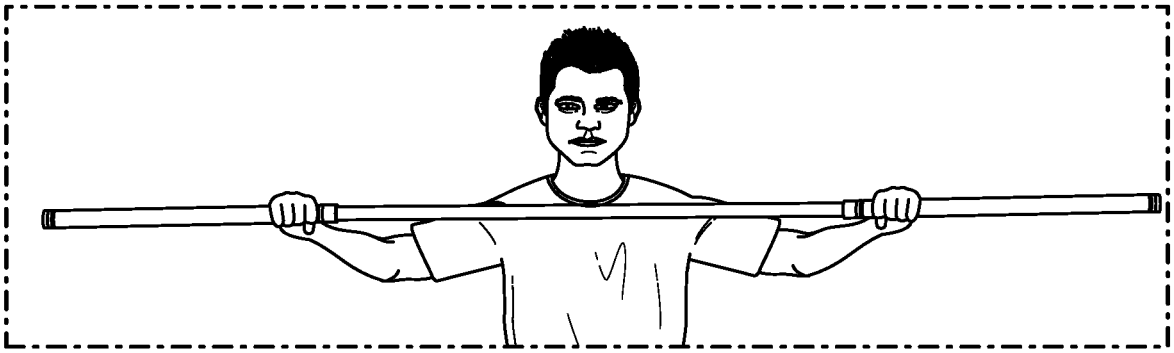

FIG. 13B illustrates a disclosed embodiment in use, showing an embodiment in the extended position with the user having a narrow grip. (both hands are at the inside ends of the handles)

Figure 14A:
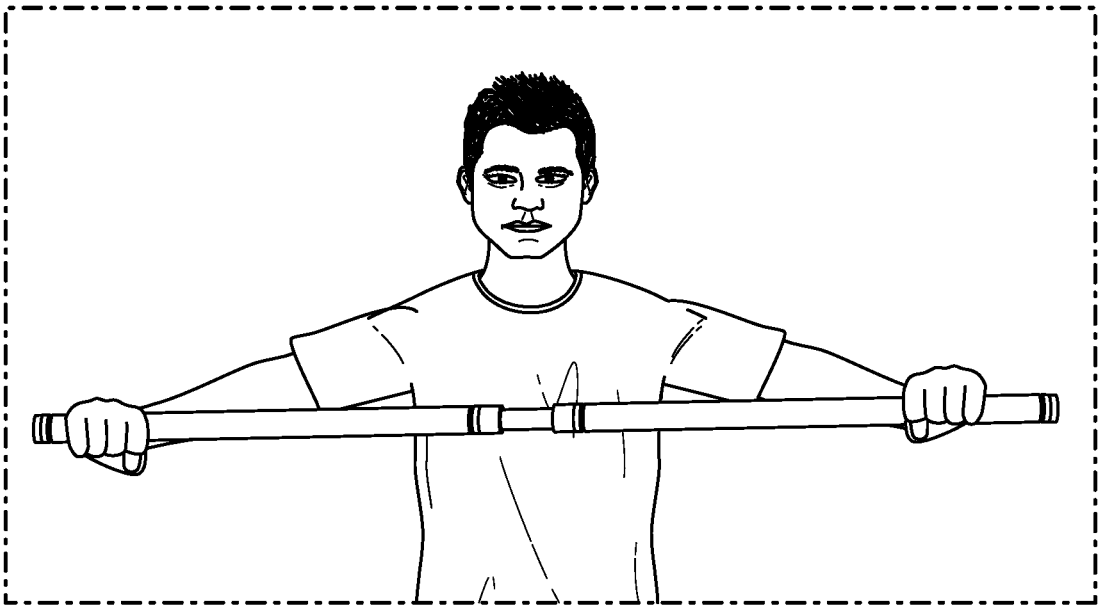

FIG. 14A depicts a disclosed embodiment in use, showing an embodiment in the retracted position with the user having a wide grip (both hands on outside ends of the handles)

Figure 14B:
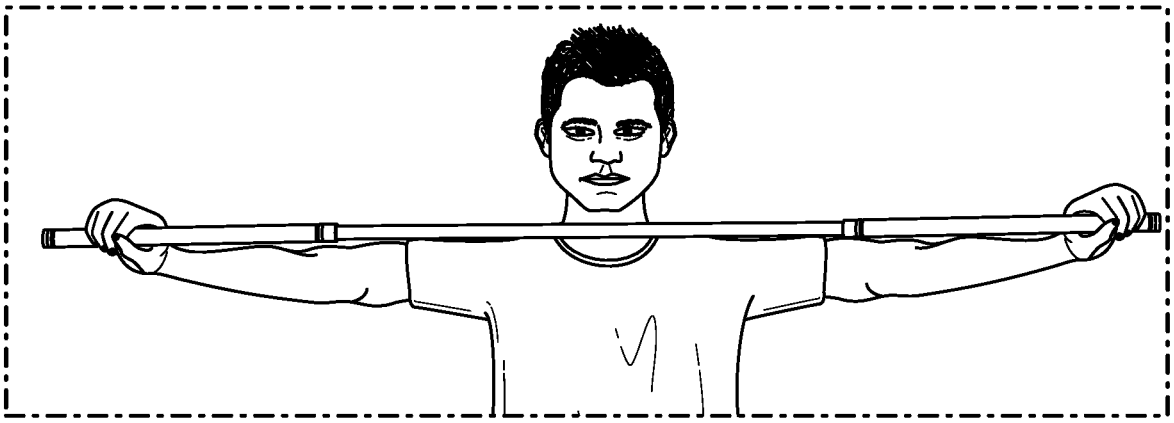

FIG. 14B depicts a disclosed embodiment in use, showing an embodiment in the extended position with the user having a wide grip (both hands on outside ends of the handles)

Figure 15A:
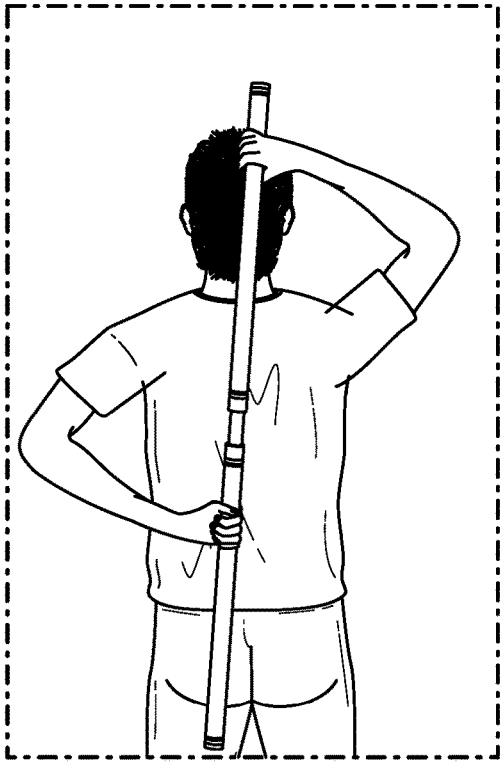
Figure 15B:
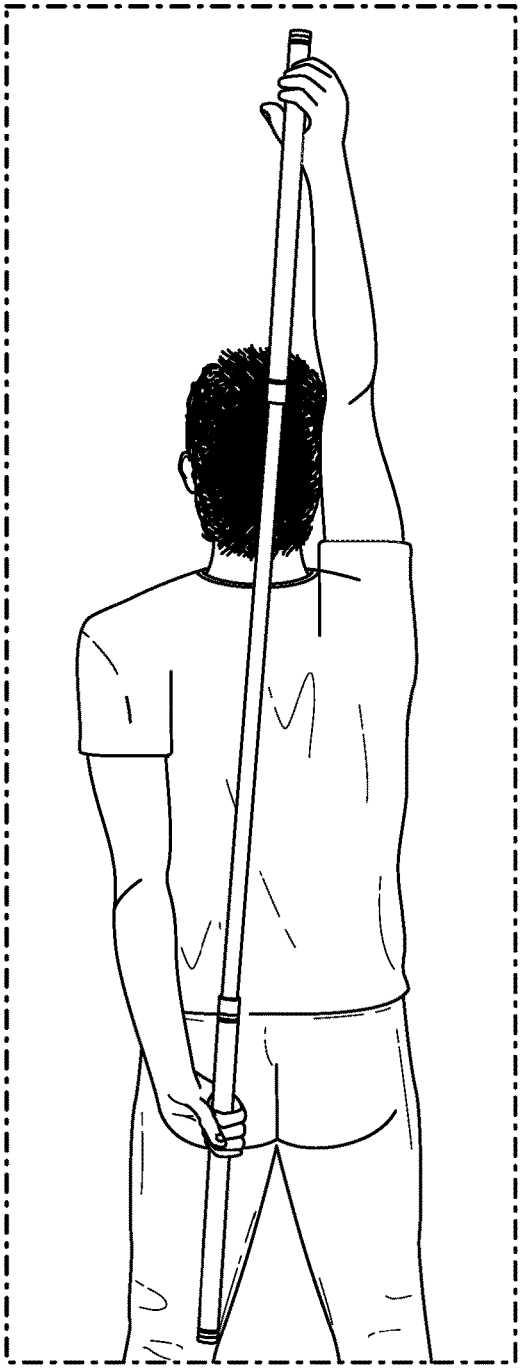

FIG. 15A depicts a disclosed embodiment in use, showing the embodiment in the retracted position with the user having a mixed grip (one hand at the inside end of one handle and on the outside end on the other handle)

FIG. 15A depicts a disclosed embodiment in use, showing the embodiment in the extended position with the user having a mixed grip (one hand at the inside end of one handle and on the outside end on the other handle)

Means and/or Possible Sequences of Assembly

Completed Device Assembly

A disclosed assembled device 90 is intended to be inseparable to the end user. As most of the attachments, including the frictional fit attachment, or fasteners described below are intended to be permanent interference (press) fits the order of operations for the assembly are important. This narrative description shows the proposed order and method of the assembly.

300—Elastic Resistance Assembly

Item 301 is a cut length of latex or other elastic type resistance tubing. Item 302 is a plastic center stopper that holds item 301 in the center of item 200. Item 301 is cut to a length that is a few inches longer than item 204, and its center 330 is marked. Two additional marks 331 are made at equal distances from the center mark. These marks 331 note the "as-installed" lengths the tube 301 will be cut to later in the assembly process. The "as-installed" length will be shorter than center rigid tube 204 by a predetermined amount, so that a net force will remain to keep the device in a retracted position when at rest. Elastic resistance member 301 is then stretched 332 near the center mark 330, and is inserted in the slot feature 333 of item 302, with the center mark 330 visible through the void 334. When released, Item 301 will retract to fill the slot 333 in item 302 and be engaged with the tooth-like protrusions 335 inside the slot 333. In this manner the elastic resistance member 301 is effectively captured or retained in its center for the life of the device.

The completed elastic resistance assembly 300 is then assembled into a center tube 204. One end of item 301 is fed into item 204 until item 302 prevents it from moving any further. Item 302 will then be pressed into item 204 a prescribed length until it is centered. The diameter of item 302 is a close fit into the center of item 204. The center stopper 302 will spring open slightly along the connecting edge 336 of its two semi-cylindrical halves due to the added force from the elasticity of item 301. This force will act to hold the entirety of assembly 300 in the center of assembly 200 for the life of the device. The extra few inches of item 301 length should be visible sticking out each end of item 204, and facilitates assembly.

Item 100—Handle Tube Assembly—Part 1

Assembly 100 is used twice within the completed device. The left and right sides are assembled with the same parts but are placed in a mirrored configuration within the device. Items 104 may be comprised of thin-walled lightweight carbon fiber tubes. Items 105 may be machined aluminum caps that are assembled onto each end of item 204 by means of a permanent interference (press) fit. On the completed device, both items 105 face each other at the center of the device. Items 106 may be split low-friction linear bushings. The split 116 allows their diameter to be reduced slightly to fit inside of items inner cap 105, and then snap into the machined groove 117 which holds them in place. The inner diameter is sized to be a sliding fit on the outside of assembly 200 (item 204). Once assembled to this point, the two partial assemblies 100 must be slid onto item 204, with the items 105 touching at the center.

Item 200—Center Tube Assembly

Now assembly 200 can be completed. Item 204 may be a thin-wall lightweight carbon fiber tube. Items 203 may be machined aluminum caps that are assembled onto each end of item 204 by means of a permanent interference (press) fit. Items 202 may be split low-friction linear bushings. The split 220 allows their diameter to be expanded slightly to fit over the end of items 203, and then snap into the machined groove 221 which holds them in place. The outer diameter is sized to be a sliding fit inside assembly 100 (item 104). Item 201 may be a soft rubber o-ring—that acts as a bumper, preventing contact between items 203 and items 103 (assembly 100) when the device is in the fully retracted position. Item 205 may be a soft rubber o-ring that acts as a bumper, preventing contact between items 203 and items 105 (assembly 100) when the device is in the fully extended position.

Item 100—Handle Tube Assembly—Part 2

Item 103 may comprise machined aluminum caps that are assembled onto each outer end of item 104 by means of a permanent interference (press) fit. Once these are fitted, the handle assemblies 100 may not be removed from the center assembly 200. Now each end of item 301 may be pulled and stretched until the "installed length" mark 331 is visible. Each end is cut on the mark 331 and inserted fully onto the barb feature 115 of item 101. Item 102 is then pushed over items 101 and 301 to lock it in place. Similar to item 302, item 102 is sized to be a close fit inside the inner diameter of item 103 and contains a single connecting edge 118 joining its two semi-cylindrical halves. Item 102 will be forced apart slightly by the elasticity of item 301. When pressed inside of item 103, the resulting force holds everything in place for the life of the device. Additionally, a resistance member plug seal o-ring item 107 is placed into a groove in item 101 to create a seal between item 101 and item 103.

The assembled device 90 is now ready for use. The stretched and captured elastic resistance tube 301 provides a static force keeping the device fully retracted when not in use. In use, the opposing pairs of low friction linear bushings 106 and 202 provide for a smooth stroke while the user pulls against the gently increasing force provided by 301. The bushings 106 and 202 riding on and in the stiff tube members 104 and 204 keep the device aligned and rigid from fully retracted through fully extended positions.

An important feature of a disclosed embodiment is that it remains substantially straight and rigid 540 during use, with a single primary linear degree of freedom 500: it can expand and contract along the length of its main axis only. There is a secondary rotational degree of freedom 550 as each handle tube assembly 100 can rotate with respect to each other and the center tube assembly 200 along the main tube axis. This rotational freedom gives some additional exercise options to the user, and allows for each hand to assume its natural rotational alignment for comfort during exercise. The combination of the two degrees of freedom along with high linear rigidity is accomplished primarily through the use of two pairs of counteracting low friction bushings 106 and 202 and the highly rigid tube pieces 104 and 204. The bushings counteract any bending moment 510 (force trying to bend the tube along its main axis) by providing a reaction force 530 against the same tube surface that it slides against. Even at full extension the disclosed device can resist the typical bending forces 510 that may arise during use. In a preferred embodiment, the handle tubes 104 and center tube 204 are made of carbon fiber composite tubing, chosen for its light weight and high rigidity. The low friction bushings 106 and 202 are made of PTFE, chosen for its combination of low friction coefficient, resistance to wear, and load bearing properties.

A further feature of the assembled device is that it defines an internal volume of air contained within the center and handle tubes. In the retracted position this volume is made up of internal volume of the center tube 204, shown as 400. There are small additional volumes from the gaps between the handle tubes 104 and the center tube 204, shown as 401. The total volume in the retracted position is therefore approximately the sum of the separate volumes 400 and 401. As the device is extended during use, the volume of air within the device increases. This additional volume is primarily the internal volume of the handle tubes 104, shown as 402. The total volume in the extended position is therefore approximately the sum of the separate volumes 400 and 402, which is greater than the total volume of the device when in the retracted position. Due to the resistance member plug seal o-rings 107, the air can only enter and exit the device during use through the very small radial gaps between the outer diameter of the center tube 204 and the inner diameter of the bushings 106, and the gap created by the split in the bushings 116. The width of the split 116 within bushing 106 can be tuned to allow a precise amount of air to flow through the gap. In a preferred embodiment, the width of the split 116 is approximately 1 mm (0.04"). Similarly, the bushings 202 with split voids 220 also act to further meter the air moving within the device, as air passes between volumes 402 and 401. In a preferred embodiment, the width of the split 220 is also approximately 1 mm (0.04"). This metering of the air flow in the four locations (two each side) acts to damp the extend and retract motion of the device. As the handles are pulled apart and the internal volume increases, the air pressure within the device falls, and air is sucked in through the bushing splits 116. As the handles retract and the internal volume decreases, the air pressure within the device rises, and air is pushed out the bushing splits 116. The static force exerted by the device on the user is due to the elastic properties of the resistance tubing 301, and this force changes with the length of the device only. The action of the air traveling within, and in and out of the device during use gives rise to an additional damping force. As damping is defined as being proportional to speed, the magnitude of the additional force generated depends on how fast the user extends and retracts the device. This additional damping force has two benefits: First, it acts to increase the overall resistance force if the user tries to extend or retract the device too quickly, giving additional benefit to the exercise. Second, it retards the return stroke of the device which allows for a more gentle retraction. The damped return stroke prevents the unit from slamming closed if the user were to let go, and results in a safer device.

In a preferred embodiment, the elastic resistance tube 301 is a piece of natural latex rubber tubing with an outer diameter of 8 mm (5/16") and an inner diameter of 5 mm (3/16"). When cut to the final length at marks 331, the free, unstretched length of the tubing 301 is approximately 600 mm (23.6"). When installed in the completed device, the overall length of the tubing 301 is stretched to approximately 1040 mm (40.9"). However, there are small sections of the tubing 301 that are used to hold the tubing in the center stopper 302 (approximately 10 mm (3/8") and the barbed protrusions 115 on the resistance member plugs 101 (approximately 15 mm (9/16") on each end). These sections anchor the tubing and do not participate in stretching or providing additional force during use. The net tubing 301 participating in the device force is (600 mm-10 mm-2*15 mm)=560 mm (22.0"), or 280 mm (11.0") for each half of the device. This unstretched length is then stretched to (1040 mm-10 mm-2*15 mm)=1000 mm (39.4") (500 mm (19.7") each half) when installed in the completed device in a retracted position. The initial force of the tubing within the completed device is approximately 18 N (4 lbf). When the device is in the full extended position, the initially stretched 1000 mm (39.4") becomes 1870 mm (73.6") (935 mm (36.8") each half). The final force of the tubing within the completed device is approximately 33 N (7.4 lbf). This gives an effective spring rate (or spring constant), K, of approximately 0.017 N/mm (0.1 lbf/in) (for the completed device between the retracted and extended positions. This low spring rate gives a gentle, slowly increasing pull force during use. An important feature of the completed device is that the force range is the same regardless of where on the handle assemblies the user grips the device. This allows the user a wide range of exercises with narrow, wide, or mixed grip options, or anywhere in between, without changing the force range or potential stroke length. In other embodiments, the initial and final forces, as well as the overall spring rate, can be varied by altering the inner and outer diameters or the tubing, the initial free length, the overall shape and/or cross section of the elastic resistance member, as well as the material properties.

The disclosed embodiments overcome shortfalls in the art by providing:

Dual telescoping handles providing:

A rigid, aligned structure throughout motion

Pairs of counteracting low friction linear bushings for smooth motion

Built-in end stops with bumpers to cushion the extend stroke limit and the retract stroke limit Novel mechanical means to attach resistance tubing in center and on ends:

Balanced force during use

Keeps center section "centered" for maximum rigidity

Completely encapsulated elastic resistance member:

Protects elastic resistance member from wear, damage, debris

Protects user from safety issues possible with damaged elastics

Consistent, symmetrical exercise force regardless of where the handles are gripped Takes advantage of low spring rate of a long piece of elastic resistance material; long life Requires no setup or maintenance to give consistent force with every use; self-contained Damped extension and retraction force provided by the metering of the air flowing within, and into and out of the device through the openings in the split low friction bushings.

What is claimed is:

1. An exercise device (90) comprising a first handle tube assembly (100), a second handle tube assembly (100), and a center tube assembly (200), wherein each of the first handle tube assembly (100) and the second handle tube assembly (100) are in slidable attachment to the center tube assembly (200), a) the center tube assembly (200) comprising:

i) a center tube (204) and an elastic resistance assembly (300), wherein the elastic resistance assembly (300) comprises an elastic resistance member (301) and a center stopper (302), the elastic resistance member (301) comprising a first end, a second end and a center area wherein the elastic resistance member (301) provides a static force for keeping the exercise device (90) fully retracted when not in use, the center stopper (302) is in frictional fit attachment to the center area of the elastic resistance member (301), the center stopper (302) is also in frictional fit attachment to the center tube (204), wherein the center stopper (302) comprises a stretched section of the elastic resistance member (301) therewithin;

b) the first handle tube assembly (100) comprising a first handle tube (104) having a distal end in frictional fit attachment to a first resistance member plug (101), wherein the first resistance member plug (101) is in frictional fit attachment to the first end of the elastic resistance member (301); and c) the second handle tube assembly (100) comprising a second handle tube (104), wherein the second handle tube assembly (100) is a mirror copy of the first handle tube assembly (100), having a distal end in frictional fit attachment to a second resistance member plug (101), wherein the second resistance member plug (101) is in frictional fit attachment to the second end of the elastic resistance member (301).

2. The exercise device (90) of claim 1, wherein each of the first handle tube assembly (100) and the second handle tube assembly (100), respectively, further comprises, an outer cap (103), a resistance member plug retainer (102), an inner cap (105) and a linear bushing (106), wherein the distal ends of each of the first handle tube (104) and the second handle tube (104) are in frictional fit attachment to the respective outer cap (103) the respective resistance member plug retainer (102) and proximal ends of each of the first handle tube (104) and the second handle tube (104) are in frictional fit attachment to the respective inner cap (105) and the respective linear bushing (106).

3. The exercise device (90) of claim 1, wherein the center tube assembly (200) further comprises two distal ends, each distal end of the center tube (204) is in frictional fit attachment to a respective center cap (203) with each of the center caps (203) separately in frictional fit attachment to a respective extend bumper (205", linear bushing (202), and return bumper (201), wherein the two distal ends of the center tube (204) are a mirror copy of each other.

4. The exercise device (90) of claim 1, wherein a center portion of the center stopper (302) defines a centering void (334), a center mark is disposed upon a center area of the elastic resistance member, wherein the center mark is aligned with the centering void (334) to position the elastic resistance member (301).

5. The exercise device (90) of claim 1, wherein the center stopper (302) comprises a connecting edge (336) the connecting edge in flexible attachment to two halves of the center stopper, with the two halves of the of center stopper defining a center void, with the center void containing the stretched region (332) of the elastic resistance member (301) to retract and push apart the two halves of the center stopper (302) along said connecting edge (336), wherein when the center stopper (302) is disposed inside the center tube (204), an added force on the elastic resistance member (301) is obtained by the center stopper (302) closing on the elastic resistance member and wherein the center stopper comprises tooth protrusions (335) for retaining the stretched section of the elastic resistance member (301).

6. The exercise device (90) of claim 1, further comprising a resistance member plug retainer (102) in frictional fit-attachment to an outer section of the elastic resistance member (301).

7. The exercise device (90) of claim 6, wherein the resistance member plug retainer (102) comprises a connecting edge (118) allowing the resistance member plug retainer (102) to expand when in frictional fit attachment to the elastic resistance member (301), wherein when the resistance member plug retainer (102) is disposed inside an outer cap (103), an added force on the elastic resistance member (301) is obtained by the resistance member plug retainer (102) closing on the elastic resistance member.

8. The exercise device (90) of claim 1, further comprising linear bushings (106 and 202) to define split voids (116 and 220), wherein the split voids (116 and 220) are used to regulate air flow within, in and out of the exercise device (90) during movement of the first handle tube assembly (100) and the second handle tube assembly (100) with respect to the center tube assembly (200).

* * * * *